United States Patent [19]

Wechner

[11] Patent Number: 4,813,530

[45] Date of Patent: Mar. 21, 1989

[54] CONVEYOR DRIVE FOR MINER

[75] Inventor: Edward Wechner, Minnamurra, Australia

[73] Assignee: Joy Technologies Inc., Pittsburgh, Pa.

[21] Appl. No.: 847,968

[22] Filed: Apr. 3, 1986

[51] Int. Cl.[4] ..... B65G 37/00

[52] U.S. Cl. ..... 198/516; 198/576; 74/425; 299/64

[58] Field of Search ..... 198/576, 512, 516; 74/425, 428; 299/64, 65

[56] References Cited

U.S. PATENT DOCUMENTS

| | | | |
|---|---|---|---|
| 2,120,274 | 6/1938 | Cartlidge | 198/516 |
| 2,151,741 | 3/1939 | Cartlidge | 198/516 |
| 2,381,108 | 8/1945 | Cartlidge | 198/516 |
| 2,696,288 | 12/1954 | Ball | 198/18 |
| 2,701,046 | 2/1955 | Cartlidge | 198/516 |
| 2,737,284 | 3/1956 | Ball | 299/64 |
| 2,764,396 | 9/1956 | Moon | 198/516 |
| 2,768,728 | 10/1956 | Bowman | 198/516 |
| 2,880,842 | 4/1959 | Abraham | 198/10 |
| 3,190,699 | 6/1965 | Ward | 198/512 |
| 3,554,044 | 1/1971 | Hoglund | 74/425 |
| 3,762,234 | 10/1973 | Hoglund | 74/425 |
| 4,159,055 | 6/1979 | Eberlf | 299/67 |
| 4,215,592 | 8/1980 | Calvert | 74/425 |
| 4,886,051 | 12/1984 | Becker | 74/425 |

*Primary Examiner*—Gary L. Smith
*Assistant Examiner*—Eric K. Nicholson
*Attorney, Agent, or Firm*—Kirkpatrick & Lockhart

[57] ABSTRACT

A conveyor drive transmission for a secondary conveyor system is disclosed. The secondary conveyor system is designed to feed material cut by a mining machine onto a primary conveyor which would convey mine material to the rear of the machine for discharge. The secondary conveyor has a foot shaft adjacent and parallel to one side of the primary conveyor. The transmission for the secondary conveyor includes an input drive shaft aligned with and driven by a transverse shaft on the primary conveyor. A helical worm drive gear mounted on and driven by the input drive shaft is included to engage and drive a worm wheel. The worm wheel then drives a helical worm gear mounted on a shaft in the same plane as the input drive shaft. A set of bevel gears mounted on the same shaft as the helical worm driven gear drives the worm shaft of the secondary conveyor.

9 Claims, 2 Drawing Sheets

CONVEYOR DRIVE FOR MINER

This invention relates to a transmission drive arrangement for a conveyor and is related especially, but not exclusively, to such an arrangement for driving at least one lateral conveyor, generally known as a "face conveyor", of a continuous mining machine more commonly known as a "continuous miner." An example of such a machine is described in our co-pending patent application Ser. No. 612,215 entitled "Continuous Miner", now U.S. Pat. No. 4,655,507.

Face conveyors are generally located in pairs transversely across the front of a continuous miner below the cutting heads, and arranged to feed coal or other materials transversely inwardly to a centrally located lateral main conveyor for transfer to the rear of the miner.

Also, the inventive transmission drive arrangement could be incorporated in other forms of cutting machine, such as, a borer or road heading machine, where cut material has to be removed by conveyor means from the vicinity of the machine.

A problem associated with mining machines, such as, continuous miners, is that the face conveyors have to be located within the very limited space defined between the front or cutting end of the mining machine and the face of a seam being cut or between the face of the seam being cut and a line or plane adjacent the front end of a main conveyor for removing cut coal or other minerals rearwardly of the miner. It is also important to keep the overall height of the face conveyors as low as possible to clear the cutting heads of the miner and their associated drive mechanisms.

An advantageous arrangement for driving a pair of lateral drive or face conveyors used to feed cut coal or other minerals to a main conveyor is to utilise power from the driven main conveyor itself. However, it has been found that conventional transmission drive arrangements used in this type of machine for driving the face conveyor(s) are bulky and take-up an excessive amount of space in the severely restricted confines between the cutting or working, front end of the mining machine and the seam face.

Accordingly, it is an object of the present invention to eliminate, or at least substantially reduce, this undesirable disadvantage which is associated with known transmission drive arrangements between main and face conveyors.

Accordingly the invention consists in a conveyor drive transmission for a secondary conveyor arranged to feed material therefrom onto a primary conveyor, the secondary conveyor having a foot shaft adjacent and parallel to one side of the primary conveyor, the transmission comprising an input drive shaft aligned with and driven by a transverse shaft on the primary conveyor, a helical worm drive gear mounted on and driven by the input drive shaft, a worm wheel engaged with and driven by the worm drive gear, a helical worm driven gear mounted on a lay shaft in the same plane as the input drive shaft and engaged with and driven by the worm wheel, and a set of bevel gears driving the foot shaft of the secondary conveyor from the lay shaft.

Preferably the input drive shaft and the lay shaft are parallel to one another, and lie in the same plane in which are also located the foot shaft and the worm wheel.

Preferably two said transmissions are provided, each arranged to drive one of a pair of secondary conveyors located one either side of, and feeding onto the primary conveyor, the input drive shafts of each transmission being driven from opposite sides of the said main conveyor transverse shaft, and wherein a torque sharing drive shaft is operatively connected between the lay shafts of each transmission.

Preferably the primary conveyor comprises the main longitudinal conveyor of a continuous mining machine and the secondary conveyors comprise lateral face conveyors extending transversely outwardly from the forward end of the main conveyor.

Notwithstanding any other forms that may fall within its scope, one preferred form of the invention will now be described, by way of example only, with reference to the accompanying drawings, in which.

Figure 1:
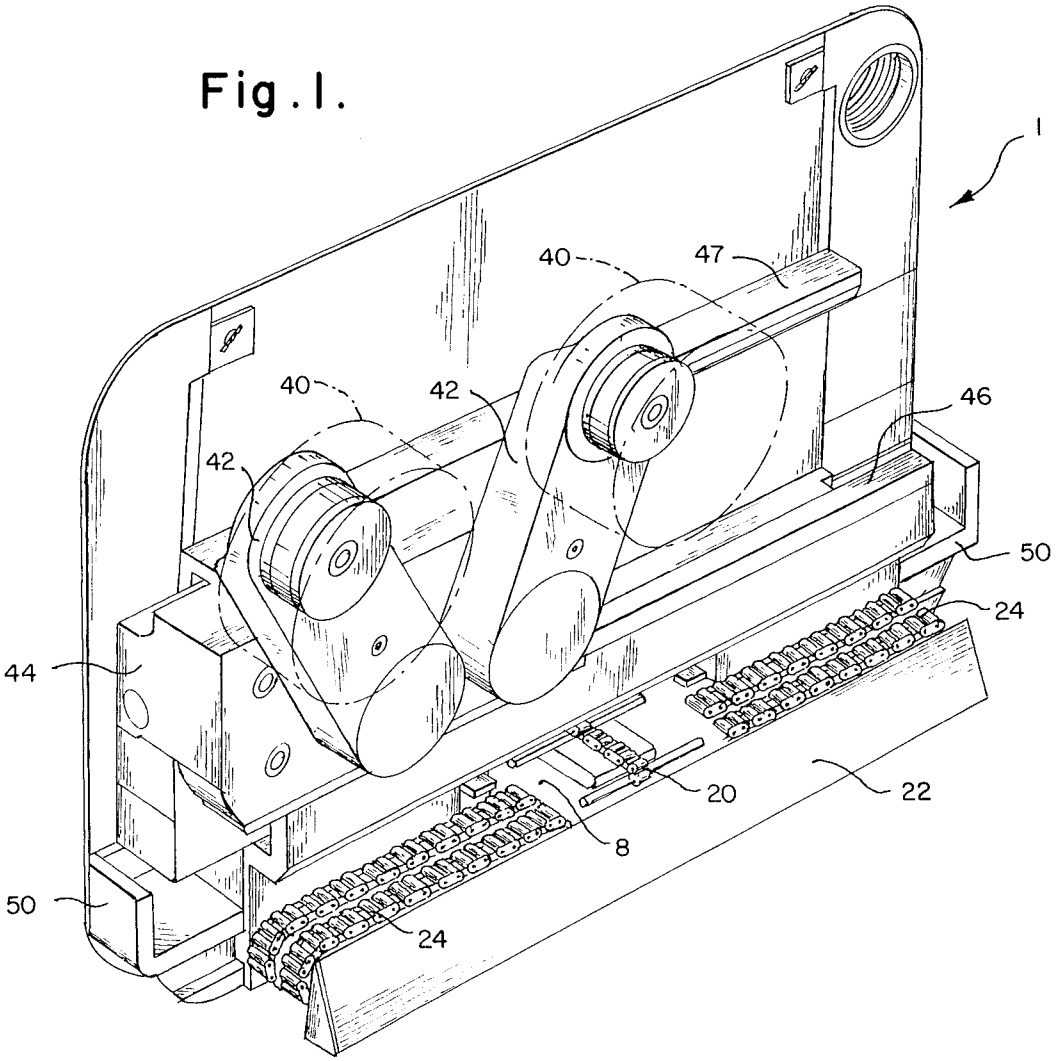
FIG. 1 is a general, perspective front view of the cutting or working end of a continuous miner incorporating a conveyor drive transmission according to the invention.

Referring to the drawings, the cutting or working, front end 1 of a continuous miner, such as that described and claimed in our co-pending patent application Ser. No. 612,215, now U.S. Pat. No. 4,655,507 is shown in FIG. 1. Here, a main conveyor 8 extends from the front end 1 to the rear end of the chassis 50 of the miner and is tiltable about a pivot (not shown) in an upwards direction to enable cut coal to be conveyed into a waiting shuttle car (also not shown). The front of the main conveyor 8 is disposed in a loading apron 22 which is arranged to collect coal as it is cut from the coal face. The main conveyor 8 typically comprises a flight conveyor driven by a chain drive 20. The loading apron 22 includes a pair of the lateral side conveyors 24 which convey the cut coal inwardly toward the main conveyor 8, the coal having been cut from the face by two rotating cutting drums 40 mounted upon pivotable ranging arms 42 which are, in turn, mounted for pivotal movement on a support member 44. This member 44 is mounted slidably on linear bearing members 46, 47 extending across the front of the chassis 50 of the miner.

Figure 2:
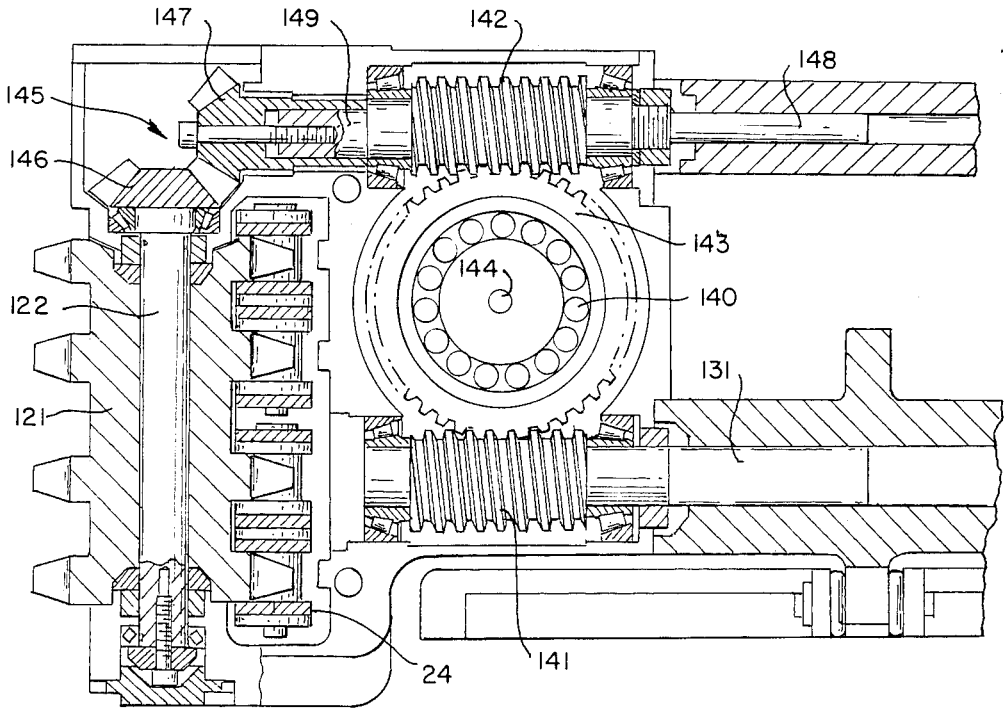
FIG. 2 is a sectional plan view of part of the forward end of the miner shown in FIG. 1, showing the conveyor drive transmission according to the invention.
Figure 3:
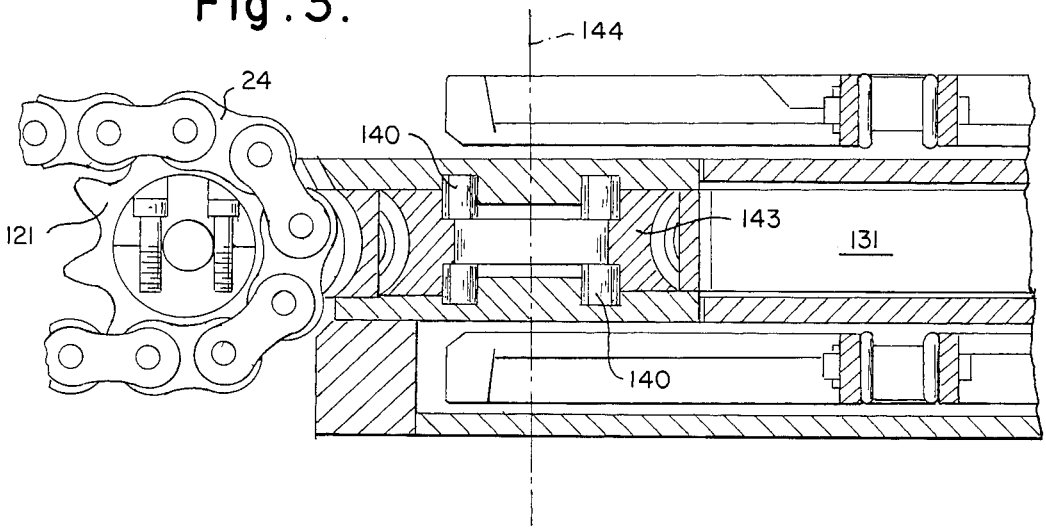
FIG. 3 is a sectional elevational view of the arrangement shown in FIG. 2.

Each of the pair of lateral side conveyors 24 comprises a chain conveyor with sprockets at each end thereof. The sprocket at the outer end of each lateral side, chain conveyor 24 is not shown in the drawings but is an idler sprocket. The sprocket 121, as shown in Figs. 2 and 3, at the inner end of each lateral side, chain conveyor 24, is a driving sprocket driven, via conveyor transmission drive from the front foot shaft 131 of the main conveyor 8, as also shown in FIGS. 2 and 3. In turn, the front foot shaft 131 of the main conveyor 8 is driven by the operating movement of the main conveyor which is driven by means not shown but usually in the form of an electric motor located at or adjacent the rear of the continuous miner or at any other suitable position.

For convenience and ease of reference, FIGS. 2 and 3 show only the drive transmission for the lateral side conveyor 24 at the right hand side of the miner. A similar transmission is driven from the opposite end of the main conveyor foot shaft 131 to drive the left hand side conveyor.

The drive transmission, which transmits power from the foot shaft 131 of the main conveyor 8, comprises a helical worm drive gear 141 connected to and driven directly off the shaft 131. The worm gear 141 is in meshing engagement with a generally planar worm wheel 143 rotatable about a generally vertical axis 144 and typically located in bearings 140 (FIG. 3). A helical worm driven gear 142 is diametrically opposed to the worm gear 141 with respect to the worm wheel 144 and is also in meshing engagement with the latter and is mounted on lay shaft 149. The lay shaft in turn drives the input gear 147 of a bevel gear set 145. In turn, the foot shaft 122 of the sprocket 121 at the inner end of the lateral side, chain conveyor 24 is connected to the output gear 146 of the bevel gear set 145.

The other, lateral side chain conveyor 24, shown on the left hand side of the miner in FIG. 1 but not illustrated in FIGS. 2 and 3, is driven by a similar conveyor drive transmission driven from the opposite end of the main conveyor foot shaft 131. The lay shafts 149 of the two transmissions are connected by a torque sharing drive shaft 148 (typically extending through the main conveyor) so that the drive to either lateral side conveyor is taken through both sets of worm wheels 143. This has the advantage that a heavy load of coal on one side conveyor, requiring considerable power to move, may be moved by torque applied to the relevant side conveyor through both sets of worm gears.

The gear ratio of the first worm 141, worm wheel 143 and second worm 142 is obviously 1:1 but the ratio of the bevel gear set 145, and of the other gear set driven by the shaft 148, can be adjusted to suit necessary operating requirements. In this particular embodiment, the ratio of the bevel gear set 145 is from 1:1.2 to 1:1.8 and, preferably 1:1.6. The worms 141, 142, worm wheel 143 and gears of the two bevel gear sets are mounted on suitable bearings which are of known type and, as such, will not be discussed further.

The generally planar and compact configuration of the conveyor drive transmission described above can be located easily within the confines of the other adjacent, outer components of the miner, such as, the loading apron 22 and between the respective pairs of planes in which lie the upper and lower flights of the main side conveyor 8. This arrangement also does not protrude into the extremely confined working space between the front end 1 of the miner and the coal face being worked. Further, no additional drive means is required for the pair of lateral side conveyors 24, in that they are driven, via the inventive transmission drive arrangement, by the drive associated with the main conveyor 8.

Although the lateral side conveyors 24 are described above as being chain conveyors, they may of course take any other suitable form, for instance, belt or flight conveyors. Similarly, the main conveyor 8 can be a belt or chain conveyor, as opposed to the flight conveyor described.

I claim:

1. A conveyor drive transmission for a secondary conveyor arranged to feed material therefrom onto a primary conveyor of a continuous mining machine, the secondary conveyor having a foot shaft adjacent and parallel to one side of the primary conveyor, the transmission comprising an input drive shaft aligned with and driven by a transverse shaft on the primary conveyor, a helical worm drive gear mounted on and driven by the input shaft, a worm wheel engaged with and driven by the worm drive gear, a helical worm driven gear mounted on lay shaft in the same plane as the input drive shaft and engaged with and driven by the worm wheel, said lay shaft adapted at one end to supply torque to a second secondary conveyor, and a set of bevel gears including an input gear mounted on and rotating with said lay shaft and output gear driven by said input gear, said output gear being mounted on and rotating with said foot shaft of the secondary conveyor.

2. A conveyor drive transmission as claimed in claim 1, wherein the input drive shaft, lay shaft, foot shaft, and the worm wheel are all located in the same plane.

3. A conveyor drive transmission as claimed in claim 1, wherein the input drive shaft and the lay shaft are parallel to one another.

4. A conveyor drive transmission as claimed in claim 1, wherein the foot shaft is at right angles to the lay shaft.

5. A conveyor drive transmission as claimed in claim 1, wherein two said transmissions are provided, each arranged to drive one of a pair of secondary conveyors located on either side of, and feeding onto the primary conveyor, the input drive shafts of each transmission being driven from opposite sides of the said main conveyor transverse shaft, and wherein a torque sharing drive shaft is operatively connected between the lay shafts of each transmission.

6. A conveyor drive transmission as claimed in claim 5, wherein the primary conveyor comprises the main longitudinal conveyor of said continuous mining machine and the secondary conveyors comprise lateral face conveyors extending transversely outwardly from the forward end of the main conveyor.

7. A conveyor drive transmission as claimed in claim 6, wherein the secondary conveyors comprise chain conveyors each having one or more chains driven by sprockets on the foot shaft thereof.

8. A conveyor drive transmission as claimed in claim 5, wherein said transverse shaft on the primary conveyor comprises the foot shaft at the end of that conveyor.

9. A conveyor drive transmission as claimed in claim 1, wherein the primary conveyor comprises a flight conveyor having an upper flight plane swept by a succession of transverse flights, and a lower return flight plane parallel to and below the upper plane, and wherein at least part of the worm wheel and the helical worm driven gear are located between the upper and lower flight planes.

* * * * *